US006221313B1

(12) United States Patent
Hall

(10) Patent No.: US 6,221,313 B1
(45) Date of Patent: Apr. 24, 2001

(54) TAPHOLE KNOCKOUT DEVICE

(75) Inventor: Richard G. Hall, Hiram, OH (US)

(73) Assignee: North American Refractories Co., Cleveland, OH (US)

( * ) Notice: Subject to any disclaimer, the term of this patent is extended or adjusted under 35 U.S.C. 154(b) by 0 days.

(21) Appl. No.: 09/441,175

(22) Filed: Nov. 15, 1999

(51) Int. Cl.[7] ..... C21C 5/48
(52) U.S. Cl. ..... 266/271; 266/287; 266/DIG. 1
(58) Field of Search ..... 266/DIG. 1, 271, 266/287

(56) References Cited

U.S. PATENT DOCUMENTS

| | | | | |
|---|---|---|---|---|
| 2,535,932 | * | 12/1950 | Kemock | 266/271 |
| 2,902,832 | | 9/1959 | Levy et al. | 61/77 |
| 4,030,554 | | 6/1977 | Kammerer, Jr. et al. | 173/17 |
| 4,155,541 | | 5/1979 | Zorzi | 266/281 |
| 4,344,652 | | 8/1982 | Archenholtz et al. | 299/70 |
| 4,582,302 | | 4/1986 | Mailliet et al. | 266/287 |
| 4,715,585 | | 12/1987 | Simko | 266/273 |
| 5,110,237 | | 5/1992 | Hesse | 405/184 |
| 5,115,717 | | 5/1992 | Roemer | 91/49 |
| 5,133,534 | * | 7/1992 | Gortan et al. | 266/DIG. 1 |
| 5,332,047 | | 7/1994 | Hignite | 173/1 |
| 5,662,175 | | 9/1997 | Warrington et al. | 173/132 |

OTHER PUBLICATIONS

Holte Mfg. Co., flyer titled "Extractor Hammer," undated, known prior to invention.

* cited by examiner

*Primary Examiner*—Scott Kastler
(74) *Attorney, Agent, or Firm*—Mark Kusner

(57) ABSTRACT

A knockout device for removing a taphole sleeve from a furnace wall. The device is comprised of a pneumatic hammer having an elongated body and a weight reciprocally movable by air pressure along the body. The body has a first end with an air inlet for receiving air under pressure from an external source and a second end. A metal block is attached to the second end of the body. The block has a planar surface dimensioned to rest upon an upper end of a taphole sleeve. A locating pin extends from the block. The pin is dimensioned to be received within an axial bore defined by the taphole sleeve. A housing surrounds the hammer and defines a cavity therearound. The housing has openings therethrough to allow air from the hammer to vent from the cavity.

7 Claims, 3 Drawing Sheets

TAPHOLE KNOCKOUT DEVICE

FIELD OF THE INVENTION

The present invention relates to an apparatus for removing a taphole sleeve from a furnace wall, and more particularly to a pneumatic operated device that imparts a percussive action on the taphole sleeve.

BACKGROUND OF THE INVENTION

A taphole is an opening through a wall of a furnace for allowing molten metal within the furnace to exit therefrom. A taphole is defined by a taphole sleeve, which is basically a nozzle formed of special refractory material. The furnace wall is typically comprised of an outer metal shell, the interior of which is lined with a refractory material. The taphole opening is defined by either a single elongated taphole sleeve, or by a plurality of axially aligned, shorter sleeves. A concentric wall of refractory bricks or blocks typically surrounds the taphole sleeve(s), and a refractory material, i.e., a filler material, such as mortar, a castable or a dry sintered material fill the void or space between the concentric wall and the taphole sleeve(s).

Molten metal, slag and other impurities that flow through the taphole sleeve(s) have abrasive properties and eventually wear away the bore of the taphole sleeve(s) until there is insufficient wall thickness to sustain the flow of metal without the metal burning through the sleeve(s) into the filler material. At this point, removal and replacement of the taphole sleeve(s) is required. At the present time, taphole sleeves are generally removed by a worker using a jack-hammer to chisel away the filler material and sleeve. Because of energy costs, the furnace is normally not allowed to cool and removal of the taphole sleeve generally occurs while the furnace is still hot. In this respect, the inner portion of the furnace may still be at temperatures in excess of 2,000° F., presenting a dangerous situation for a worker removing the taphole sleeve(s).

The present invention relates to a device for removing a taphole sleeve from within the furnace, which device does not require an individual in the vicinity of the taphole sleeve.

SUMMARY OF THE INVENTION

In accordance with the present invention there is provided a knockout device for removing a taphole sleeve from the furnace wall. The device is comprised of a pneumatic hammer having an elongated body and a weight that is reciprocally movable by air pressure along the body. The body has a first end with an inlet for receiving air under pressure from an external source and a second end. A metal block is attached to said second end of the body. The block has a planar surface dimensioned to rest upon an upper end of the taphole sleeve. A locating pin extends from the block and is dimensioned to be received within an axial bore defined by the taphole sleeve. A protective housing surrounds the pneumatic hammer and defines a cavity thereabout. The protective housing has openings therethrough to allow air from the pneumatic hammer to vent from the cavity.

It is an object of the present invention to provide a device for removing a taphole sleeve from a furnace wall.

It is another object of the present invention to provide a device as described above that is operable within a furnace maintained at an elevated temperature.

It is another object of the present invention to provide a device as described above that does not require manual manipulation or the presence of a worker near the taphole sleeve.

It is another object of the present invention to provide a device as described above that utilizes a reciprocal hammer to impart a percussive action to the taphole sleeve.

A still further object of the present invention is to provide a device as described above that includes a protective housing wherein the pneumatic hammer is shielded from the elevated furnace temperature.

A still further object of the present invention is to provide a device as described above that is designed to utilize airflow from the pneumatic hammer to maintain a cooling effect thereon.

These and other objects will become apparent from the following description of a preferred embodiment of the invention taken together with the accompanying drawings.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF PREFERRED EMBODIMENT

Figure 1:
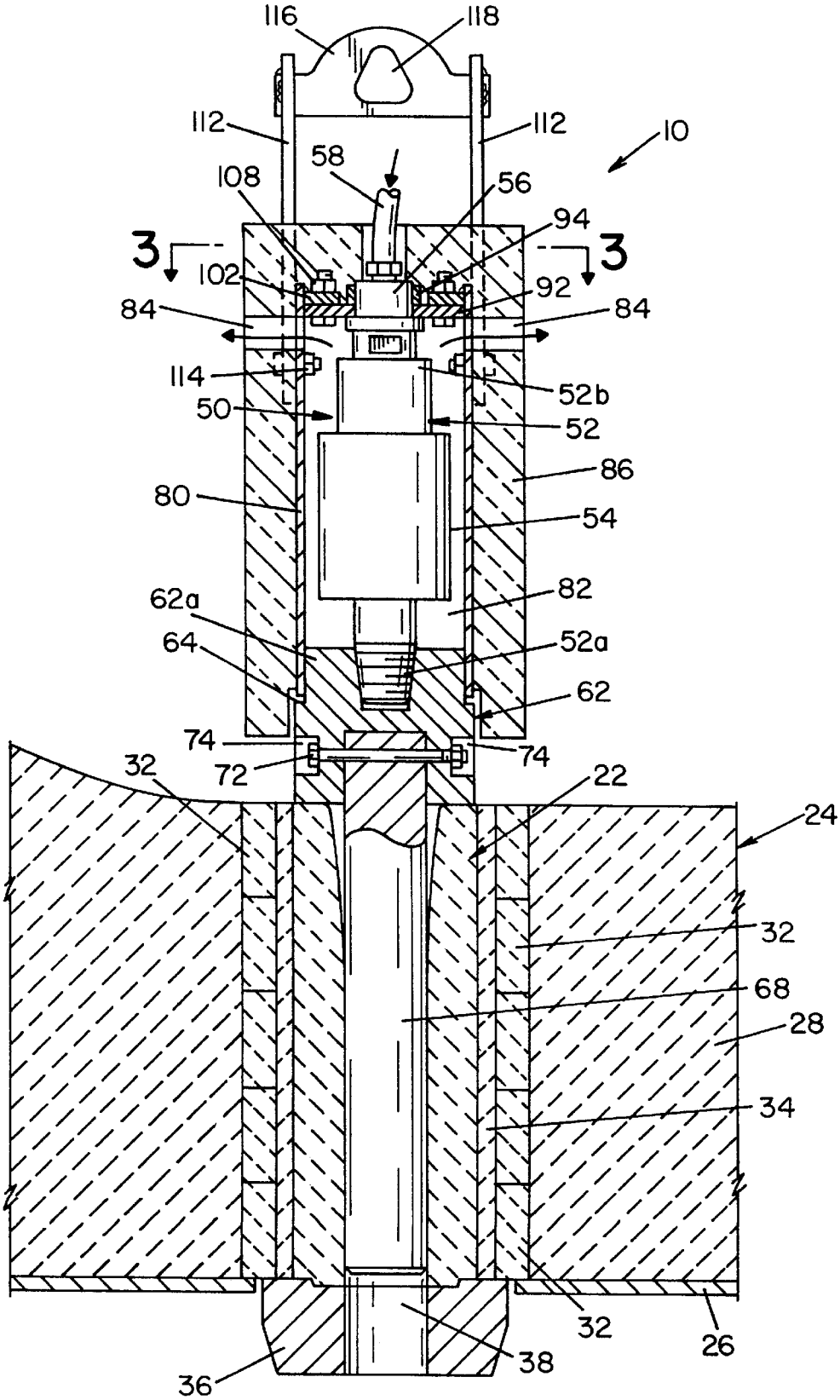
FIG. 1 is a partially sectioned, elevational view of a taphole knockout device illustrating a preferred embodiment of the present invention.

Referring now to the drawings wherein the showings are for the purpose of illustrating a preferred embodiment of the invention only, and not for the purpose of limiting same, FIG. 1 shows a taphole knockout device 10 in accordance with the present invention. Taphole knockout device 10 is shown in position relative to a taphole sleeve 22. Taphole sleeve 22 is part of a furnace wall, designated 24 in the drawings. Furnace wall 24 is generally comprised of a metal shell 26 that is lined with a refractory material 28. A plurality of refractory bricks 32 define a cylindrical opening through metal shell 26 and refractory material 28. Taphole sleeve 22 is held in place in the opening defined by refractory bricks 32 by a refractory mortar, castable or dry sintered material 34. Taphole sleeve 22 includes a lower end block 36 that is held in place by a flange ring (not shown) that is mounted to the outer shell of the furnace in a conventionally known manner. An axial bore 38 having a flared upper end is defined through taphole 22 and end block 36. Taphole sleeve 22, furnace wall 24 and end block 36 have been described for the purpose of illustration, and in and of themselves, form no part of the present invention.

Taphole knockout device 10 includes a pneumatic hammer designated 50 in the drawings. Pneumatic hammer 50 is generally comprised of an elongated body 52 having a weight 54 that is reciprocally movable along body 52 by means of pneumatic pressure. Pneumatic hammer 50 is preferably an extractor type hammer conventionally used in driving or removing drill rod or casing used in oil drilling. An extractor hammer of the type manufactured by Holt Manufacturing Company finds advantageous application in the present invention. Weight 54 is a cylindrical sleeve that is reciprocally movable under pneumatic pressure along body 52. Body 52 includes a first end 52*a* that is threaded and a second end 52*b* having an adapter 56 thereon for connection to a hose 58 that is connectable to an external source of pressurized air.

An adapter/anvil 62 is attached to the threaded end 52*a* of body 52. Adapter/anvil 62 is generally cylindrical in shape and has an upper portion designated 62*a* of reduced diameter defining a shoulder 64. Adapter/anvil 62 includes an axially lined bore at one end dimensioned to receive an elongated pin 68. Pin 68 is dimensioned to snuggly fit within axial bore 38 defined by taphole sleeve 22. In this respect, it will be appreciated by those skilled in the art that the bore size (diameter) of different tapholes used in different furnaces may vary and that pin 68 is adapted to be used in a taphole that has "opened up" (i.e., the diameter of the bore has increased) due to erosion and wear. Thus, pin 68 is dimensioned to snuggly fit into a worn taphole. Locating pin 68 is fastened to adapter/anvil 62 by a fastening element 72 extending transversely through adapter/anvil 62 and locating bar 68. In the embodiment shown, counterbores 74 are formed in adapter/anvil 62 such that fastener 72 does not extend beyond the outer periphery of adapter/anvil 62. As shown in FIG. 1, anvil/adapter 62 includes a lower planar, surface dimensioned to rest upon the upper edge of taphole sleeve 22.

Figure 2:
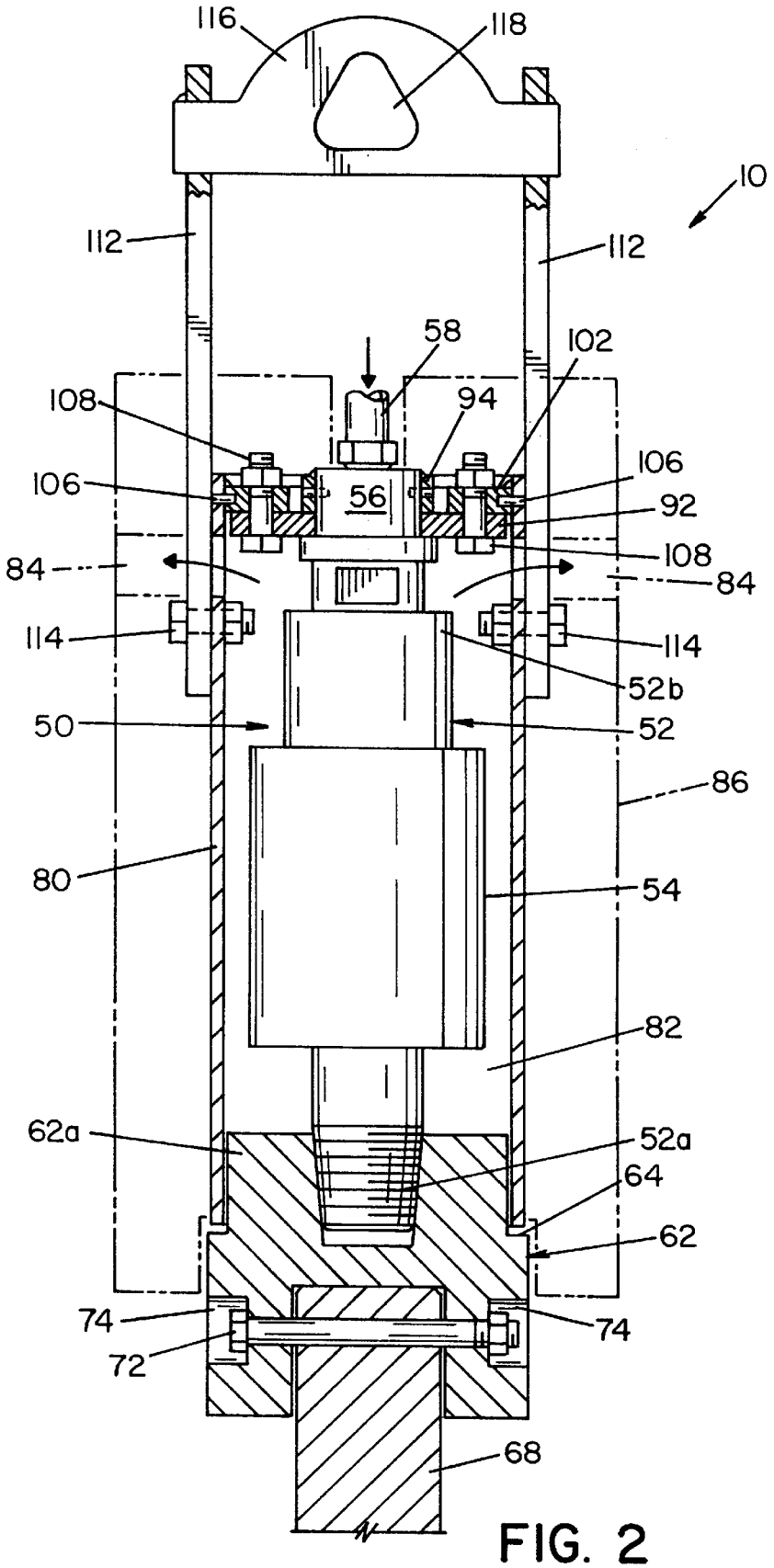
FIG. 2 is an enlarged view of the taphole knockout device shown in FIG. 1.

A protective housing 80 is dimensioned to surround pneumatic hammer 50 and capture upper portion 62*a* of adapter/anvil 62. In the embodiment shown, housing 80 is a cylindrical pipe having an inner diameter closely matching the outer diameter of upper portion 62*a* of adapter/anvil 62. As best seen in FIG. 2, housing 80 defines an annular cavity 82 that surrounds pneumatic hammer 50 and allows for free movement of weight 54. Openings 84 through housing 80 allow cavity or chamber 82 to communicate outside housing 80. An insulating jacket 86 surrounds housing 80 to thermally insulate cavity 82 from the surrounding environment. Jacket 86 may be formed from a variety of different types of insulating blanket-like material. In the embodiment shown, jacket 86 is preferably formed of a high temperature blanket material such as KAOWOOL. Jacket 86 is preferably at least two inches thick. The refractory blanket may be secured to housing 80 by wire or other conventional fastening means capable of withstanding the elevated temperatures within a furnace, such as metal straps or bands.

Figure 3:
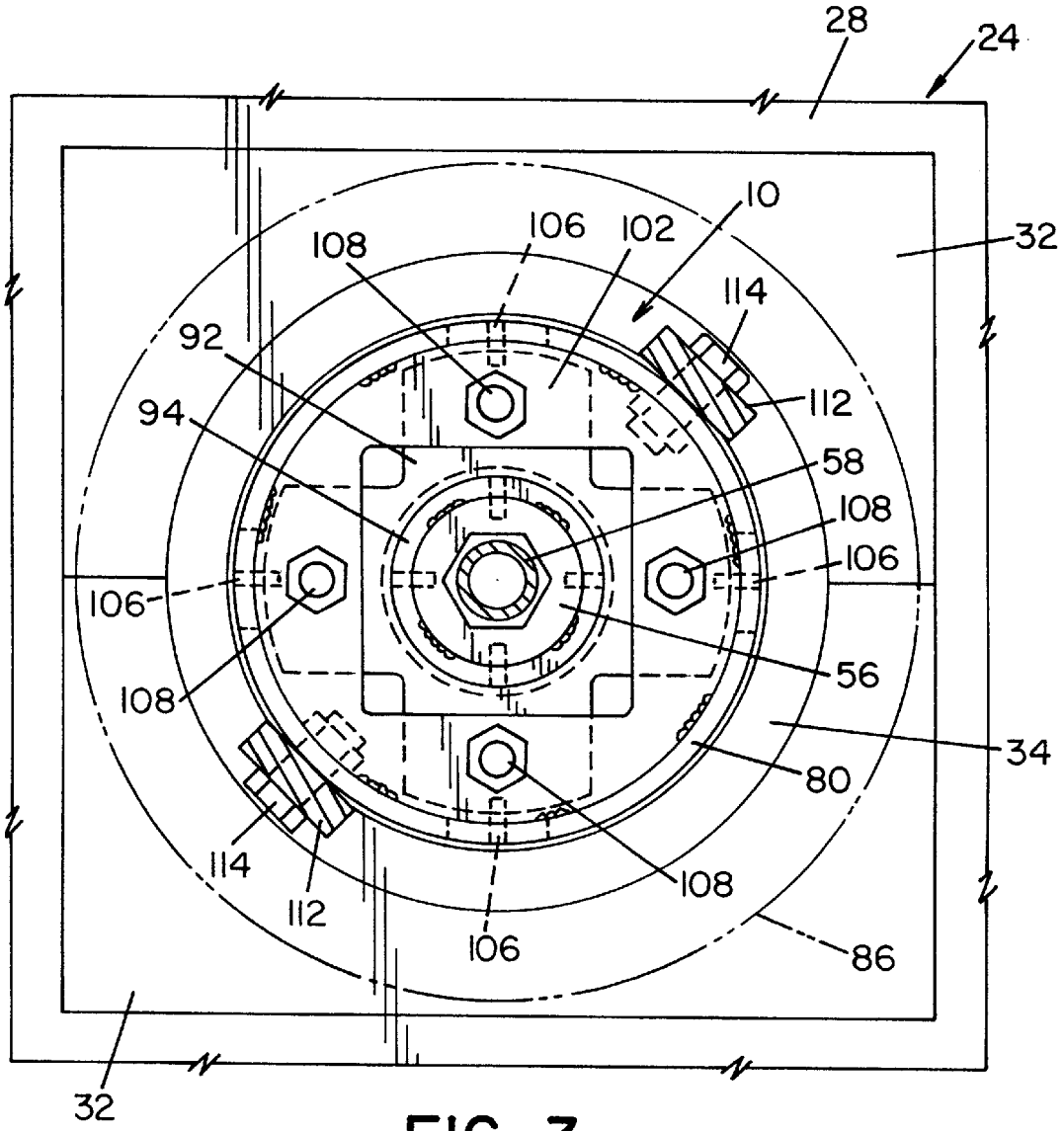
FIG. 3 is a sectional view taken along lines 3—3 of FIG. 1.

Pneumatic hammer 50 is attached to the upper end of housing 80. In the embodiment shown, a hammer bracket 92, best seen in FIG. 2, is fixedly attached to adapter 56 on pneumatic hammer 50. Bracket 92 has a cross-shaped configuration as best seen in FIG. 3. Bracket 92 is welded to a cylindrical collar 94 that in turn is welded to the adapter 56 portion of pneumatic hammer 50. As best seen in FIG. 3, reinforcing pins are added through collar 94 to reinforce same. Bracket 92 is dimensioned to be fastened to housing bracket 102. Housing bracket 102 is basically a cylindrical plate having a rectangular opening formed therein, best seen in FIG. 3. Bracket 102 is welded to the inner surface of housing 80 and includes reinforcing pins 106 inserted through housing 80 into bracket 102. Hammer bracket 92 is attached to housing bracket 102 by conventional fasteners 108. Lift bars 112 are attached to housing 80 by conventional fasteners 114. The upper ends of lift bar 112 are attached to a handle 116 having an opening 118 dimensioned to receive a hook chain or the like from an overhead conveyer. In the embodiment shown, an air hose 58 is shown attached to the upper end of a pneumatic hammer 50 to actuate the same.

Referring now to the operation of taphole knockout device 10, device 10 is adapted to be suspended by an overhead crane or conveyor (not shown) by means of a hook or chain extending through opening 118 in handle 116. Hose 58 is connected to an external source of pressurized air, conventionally found in an industrial plant to operate pneumatic hammer 50. With taphole knockout device 10 suspended by an overhead crane, taphole knockout device 10 assumes a vertical orientation as shown in FIG. 1. By means of an overhead crane, locating bar 68 is aligned with bore 38 of taphole sleeve 22. Taphole knockout device 10 is then lowered until lower surface of adapter/anvil 62 comes to rest upon the upper edge of sleeve 22. Pressured air is then directed through hose 58 to cause weight 54 on pneumatic hammer 50 to reciprocate along body 52, thereby imparting percussive movement and vibration to taphole sleeve 22. The weight of taphole device 10 together with the percussive movement of pneumatic hammer 50, vibrates and loosens taphole sleeve 22 and mortar 34, thus releasing taphole sleeve 22 from furnace wall 24. As shown in the drawings, the dimensions of adapter/anvil 62 allows taphole knockout device 10 to descend partially into the bore defined by refractory bricks 22 without contacting same.

Still further, in accordance with the present invention, air exhausted from pneumatic hammer 50 is forced through cavity 82 in housing 80 and is exhausted through opening 84. In this respect, the escaping air from pneumatic hammer 50 produces an air flow around pneumatic hammer 50 within housing 80 that maintains the temperature within cavity 82 at a temperature much less than the surrounding interior of the furnace. In this respect, the same air that actuates and operates pneumatic hammer 50 also provides a cooling jacket around pneumatic hammer 50 to prevent the elevated internal furnace temperature from adversely affecting the operation of hammer 50.

The foregoing description is a specific embodiment of the present invention. It should be appreciated that this embodiment is described for purposes of illustration only, and that numerous alterations and modifications may be practiced by those skilled in the art without departing from the spirit and scope of the invention. For example, although knockout device 10 is depicted and described as suspended vertically from an overhead crane for removing a taphole from inside a furnace, device 10 may be mounted or supported by other mechanical devices, such as a forklift or the like in different orientations and used from outside a furnace. It is intended that all such modifications and alterations be included insofar as they come within the scope of the invention as claimed or the equivalents thereof.

Having described the invention, the following is claimed:

1. A knockout device for removing a taphole sleeve from a furnace wall, said device comprised of:

a pneumatic hammer having an elongated body having a first end with an air inlet for receiving air under pressure from an external source and a second end;

a metal block attached to said second end of said body, said block having a lower surface dimensioned to engage an upper end of a taphole sleeve;

a locating pin extending from said block, said pin dimensioned to be received within an axial bore defined by said taphole sleeve; and a housing surrounding said hammer defining a cavity therearound, said housing having openings therein to allow air that is exhausted from said hammer into said cavity to vent from said cavity.

2. A knockout device as described in claim 1, wherein said housing includes an outer layer of insulating material.

3. A knockout device as described in claim 1, wherein said housing is formed from a steel pipe.

4. A knockout device as described in claim 1, wherein said first end of said body is threaded and said metal block included a mating threaded portion for attachment to said body.

5. A knockout device as described in claim 1, wherein said housing is attached to said body at a second end thereof.

6. A knockout device as described in claim 1, wherein said locating pin is axially aligned with said body portion.

7. A knockout device as described in claim 1, further comprising handle means extending from said casing for orienting said device in a vertical position with said hammer disposed above said locating pin.

* * * * *